US007458324B2

(12) United States Patent
Schneider et al.

(10) Patent No.: US 7,458,324 B2
(45) Date of Patent: Dec. 2, 2008

(54) METHOD AND DEVICE FOR ACTIVE RADIAL CONTROL OF WHEEL PAIRS OR WHEEL SETS ON VEHICLES

(75) Inventors: Richard Schneider, Thayngen (CH); Wolfgang Auer, Kassel (DE); Günther Himmelstein, Oberursel (DE)

(73) Assignee: Bombardier Transportation, Berlin (DE)

( * ) Notice: Subject to any disclaimer, the term of this patent is extended or adjusted under 35 U.S.C. 154(b) by 0 days.

(21) Appl. No.: 10/485,997

(22) PCT Filed: Jul. 29, 2002

(86) PCT No.: PCT/EP02/08436

§ 371 (c)(1),
(2), (4) Date: Dec. 7, 2004

(87) PCT Pub. No.: WO03/010039

PCT Pub. Date: Feb. 6, 2003

(65) Prior Publication Data

US 2005/0103223 A1 May 19, 2005

(30) Foreign Application Priority Data

Jul. 27, 2001 (DE) ..... 101 37 443

(51) Int. Cl.
*B61D 1/00* (2006.01)

(52) U.S. Cl. ..... 105/168; 701/42; 180/401

(58) Field of Classification Search ..... 105/168, 105/165, 166, 167, 174, 199.1, 199.2; 702/33; 701/19, 41, 42
See application file for complete search history.

(56) References Cited

FOREIGN PATENT DOCUMENTS

| | | |
|---|---|---|
| DE | 3331559 | 3/1985 |
| DE | 4413805 | 10/1995 |
| DE | 4415294 | 11/1995 |
| DE | 19617003 | 10/1997 |
| EP | 0357951 | 3/1990 |
| EP | 0374290 | 6/1990 |
| EP | 0785123 | 7/1997 |
| EP | 0870664 | 10/1998 |
| FR | 2624081 | 6/1989 |
| JP | 6199236 | 7/1994 |
| JP | 7081564 | 3/1995 |
| JP | 7081565 | 3/1995 |
| WO | WO 98/46468 | * 10/1998 |

* cited by examiner

*Primary Examiner*—Mark T Le
(74) *Attorney, Agent, or Firm*—David P. Owen; Jacobus C. Rasser; Howrey LLP

(57) ABSTRACT

The invention relates to a method for active radial control of the wheels (11, 53, 103, 108, 115) of at last one wheel unit (8, 9, 10, 51, 52) on a chassis, in particular a bogie on a tracked vehicle, whereby control movements are applied to the wheel unit (8, 9, 10, 51, 52) and an integrated regulation with control movements in at least two non-identical frequency ranges are carried out. First control movements in a first frequency range and second control movements in a second frequency range, different form the first frequency range are superimposed and applied to the wheel unit (8, 9, 10, 51, 52). The invention also relates to a device for carrying out the method.

26 Claims, 7 Drawing Sheets

METHOD AND DEVICE FOR ACTIVE RADIAL CONTROL OF WHEEL PAIRS OR WHEEL SETS ON VEHICLES

BACKGROUND OF THE INVENTION

1. Field of the Invention

The invention relates to a method and a device for active radial control of wheel pairs or wheel sets on vehicles. The invention is particularly suitable for, but not limited to, use in rail vehicles.

2. Description of the Related Art

A number of mechanical devices for the quasi-static setting of wheel pairs or wheel sets, hereinafter collectively referred to as wheel units, in track curves are known, which devices comprise passive or active means. In an active control system, the wheel units are aligned and fixed according to the radius of curvature. Such devices steer the wheel unit at a fixed relationship to the radius of curvature, thus achieving equalisation of the sums of the transverse forces acting upon the wheel units of a running gear or a vehicle at the most for a limited range. These arrangements are associated with a disadvantage in that the running stability is no better than it is in conventional running gear with rigid longitudinal guidance of the wheel units; at best the results are no worse. Furthermore, mechanical devices, for example roll stabilisers or friction-torque inhibitors are used to ensure running stability. Such mechanical devices can only be a compromise between the ability to handle curves and running stability, and, generally speaking, result in an excitation of structural oscillation in the carriage body. Frequently, additional damping elements in the wheel unit coupling are necessary.

EP 0 785 123 B1 describes a method for obtaining and processing data for the tracking of running gear comprising individual wheel units. In a method disclosed therein, the turning movement of the running gear is scanned with zero force as an angle, angular speed or angular acceleration, by means of angle sensors; the measured value or values is/are disaggregated into their frequency fractions; movements which protrude from the frequency spectra are detected as disturbing, according to amplitude, frequency and phase position; after rotation by 180° and processing, the vector or vectors identified in this way is/are supplied to a control or regulating system as information for changing the setting angle of the running gear; and the control or regulating system eliminates the disturbing motion components from the running gear movement. The invention does not take into account transverse forces between the wheel pair or wheel set and the track.

From EP 0 374 290 B1, a rail vehicle is known which on both sides along the longitudinal axis of the vehicle comprises a specifiable number of individual wheels which can be swivelled by steering action. Steering, free of any tracking error, of each individual wheel in curved sections is made possible by the provision of a device which measures the course of the track, with said device measuring the deviation of a vehicle axis from the course of the track, wherein said device, depending on the measured deviation, generates a steering signal for each individual wheel independently of the respective other wheel. Proposed devices which measure the course of the track include non-contacting systems which function on an opto-electronic or magnetic or electromagnetic basis. The invention cannot be used in conjunction with vehicles comprising wheel pairs or wheel sets.

The Japanese group of applications JP A 06199236, JP A 07081564 and JP A 07081565 describes influencing the wave running or sinusoidal running by means of hydraulic actuators between the bogie frame and the wheel set bearings. It is based on identifying the frequency of the wave running in a spectrum of the sensed translatory vibrations or yaw vibrations, wherein at least eight sensors for each bogie, as well as an extended data collection with a subsequent frequency analysis, are required.

All the hitherto known methods and devices for influencing the running characteristics of wheel units are associated with the disadvantage that they only serve the following:

1. in curves, i.e. during travelling in track curves, to bring about the corresponding tracking by steering, and/or 2. to determine the frequency of the wave running and to influence it with the same frequency, a process which requires Fourier transformation which means lost time in relation to quickly-changing profile parameters in the wheel-rail contact, but that they do not have a stabilising action on the wheel sets or wheel pairs in the sense of a real-time reaction on the current load situation and motion situation, which situations can change quickly. On a straight section of track, these measures at best make a very limited contribution to improved tracking.

BRIEF SUMMARY OF THE INVENTION

It is thus the object of the invention to overcome the described disadvantages of the state of the art and, in particular, to propose a method and a device for active radial control of wheel units on vehicles, with said method and device ensuring safe comfortable low-wear guidance of the vehicle, in particular, when the vehicle travels straight ahead, but also when the vehicle travels in curves. Furthermore, it is the object of the invention to immediately eliminate undesirable interfering movements of the wheels by means of suitable stabilisation measures, without requiring extensive data collection for a frequency analysis which would destroy the real-time effect. Wheels which roll without interference on the tracks are silent. Furthermore, wear on wheels and rails is reduced.

The method according to the invention for active radial control of the wheels of at least one wheel unit on running gear comprises an integrated control which, in at least two non-identical frequency ranges, applies control movements to the wheel unit—in the case of bogies preferably purely within the running gear, i.e. without effective mechanical connection to the carriage body. In this process, first control movements in a first frequency range, and second control movements in a second frequency range, different from the first frequency range, are superimposed and applied to the wheel unit.

Preferably, control of the running stability of the vehicle takes place as a result of the control movements in the second frequency range.

The device according to the invention for active radial control of at least one wheel unit of a vehicle—said wheel unit if need be being arranged in a bogie or the like—comprises at least one actuating device which is connected to the wheel unit for applying control movements to the wheel unit, and a control device, connected to the actuating device, for controlling the actuating device. In particular, the actuating device is used for applying to the wheel unit a rotary movement about the vertical axis, and, in addition or as an alternative, a translatory movement in transverse direction. According to the invention, the control device is arranged to control the actuating device to apply to the wheel unit, in a first frequency range, first control movements for generating quasi-static excursions of the wheel unit corresponding to the radius of curvature of a track segment to be currently travelled along. Furthermore, for the purpose of controlling the actuating device in the manner of a stability control device, said control device is arranged to apply to the wheel unit, in a second frequency range, which differs from the first frequency range, second control movements superimposed to the first control movements, said second control movements serving to generate excursions of the wheel unit for the purpose of stabilising the running characteristics of the vehicle.

In other words, the actuating device, which can be a simple actuating drive, generates excursions and forces according to the specifications of the control device, and, thus, effects a rotation of the wheel unit, i.e. of a wheel pair or wheel set, about the vertical axis and, additionally or alternatively, translatory movement of the wheel unit in transverse direction. According to the invention, the actuating device, for example the actuating drive, is arranged to generate quasi-static excursions and forces corresponding to the radius of curvature of a track segment to be travelled along, for example a track curve, and to superimpose excursions and forces of other frequency, usually higher frequency, for stabilising the running characteristics of the vehicle, both, while the vehicle travels along a curve and while it travels along a straight section of track. Particularly good setting of the transverse forces and particularly effective stabilisation can be achieved if several, preferably all, wheel units of the vehicle are controlled by way of the radial control according to the invention.

It is to be understood that the frequency of the first and second control movements are not fixed, given frequencies, but in each case frequencies which change over time, with the frequency basically being specified by the current motion state of the vehicle, in particular, by the current speed of the vehicle and the track section along which the vehicle currently moves.

In advantageous variants of the method according to the invention, the second frequency range comprises frequencies which are at least in part higher than the frequencies from the first frequency range. Preferably, the second frequency range is above the first frequency range. Further preferably, the second frequency range continues from the first frequency range. Preferred values for the first frequency range are between 0 Hz and 3 Hz, while the second frequency range is between 0 Hz and 10 Hz, preferably between 3 Hz and 10 Hz.

The invention provides an advantage in that it ensures the precise setting of wheel units in track curves so that the sum of the transverse forces which are transmitted during the wheel-rail contact is the same for all wheel units on a bogie under all operating conditions. In other words, in this way the respective resultant from the transverse forces which act upon the respective wheel set can be set such that the resultants which act upon the individual wheel units of a bogie are essentially the same, at least as far as the amount is concerned.

Furthermore, the running stability of all wheel units is ensured, both, along straight sections and along curved sections of track. In curved sections of track, the setting is also possible in the case of very substantial tractive forces and unfavourable wheel-rail parameters. Advantageous variants of the invention thus provide for the control movements in the first frequency range in sections of curved track to result in a quasi-static setting of the wheels of the wheel unit such that equalisation of the sums of the transverse forces acting on the wheels of the wheel units of the running gear takes place. In other words, in each instance a transverse force resultant acts on each wheel unit, wherein the amount of said transverse force resultant corresponds at least essentially to that of the transverse force resultants acting on the other wheel units.

The invention provides a further advantage in that it makes it possible, by means of respective settings and algorithms, to achieve special transverse force distribution among the wheel units, and/or to provoke special wear conditions between wheel and rail on the wheel units of the running gear or vehicle, so as to optimally adapt the running characteristics e.g. to specific operating conditions and/or maintenance conditions. Thus, it is possible to bring about a targeted distribution of wear for the individual wheel, i.e. to provoke a specified wear pattern in order to control the development of the wheel-track profile pairing. Thus, further preferred embodiments of the method according to the invention provide for a quasi-static setting of the wheels on the wheel unit to take place when travelling along curved sections of tracks as a result of the control movements in the first frequency range such that distribution of the transverse forces which act on the wheels of the wheel units of the bogies results, in which distribution the running behaviour is matched to specifiable operating and maintenance conditions.

In addition, diagnosis of the correct function of all components of a device operating according to the method according to the invention is possible by means of monitoring the running stability and the setting of the respective wheel unit.

Preferred variants of the method according to the invention are characterised in that control of the running stability of the vehicle takes place as a result of the second control movements in the second frequency range. Preferably, this takes place in that during control, from the measured momentary values of one or several state variables of the system, a representation of the momentary state of the mechanical system is determined, for example in the form of a corresponding stability matrix. Of course, the variabilities of the actuating devices which generate the control movements are also taken into account. Among other things, state variables include the speed and acceleration of the wheel unit in transverse direction, i.e. in the direction transverse to the longitudinal direction of the vehicle, as well as the speed and acceleration of the wheel unit about the vertical axis.

By means of suitable mathematical algorithms, this representation of the momentary state of the mechanical system is checked for stability. In the case of instability, the variable parameters of the system description originating from the actuating devices are varied in a suitable way such that or until a stable system is obtained. The "stable" momentary values for the variable parameters originating from the actuating devices and having been obtained in this way are then used for generating the control signals for the respective actuating device so as to bring about a stable system state by way of the actuating devices. In contrast to known systems for stability control in which measured values have to be acquired over an extended period of time, and in which an analysis of these measuring sequences (for example by means of Fourier transformation) is necessary, this ensures fast, direct and effective stabilisation of the system.

Thus, the solution according to the present invention obviates the need for mechanical stabilisation devices between the bogie and the carriage body for influencing the running behaviour, such as for example roll stabilisers or friction-torque inhibition devices. Moreover, there is no longer a need for damping elements in the coupling of the wheel units, in particular in the coupling linkages. Minimisation of the striking angle and thus of the track load, and minimisation or optimisation of wear on wheel and rail are further advantages of the invention. Stable running characteristics of the vehicle across the entire speed range are achieved, even at high speeds. The absence of coupling linkages between the wheel units and to the carriage body not only results in a simpler mechanical design, but also in the absence of any transmission of structure-borne noise and vibration which is usually associated with these coupling elements.

Preferably, in a vehicle whose running gear comprises a bogie, the integrated control system is designed such that it works on the inside of the running gear without effective mechanical connection to the carriage body in order not only to provide a simpler mechanical design but also to prevent the transmission of structure-borne noise and vibration through coupling elements to the carriage body, as has already been mentioned. It is to be understood that the device for signal processing or the like may of course be arranged in or on the carriage body; in this case, said device for signal processing may be connected to the elements of the actuating device merely by way of corresponding control lines such as cables or the like.

Advantageous variants of the method according to the present invention provide for the control system to control at least one fast-reacting actuating device, for example a fast-reacting actuating drive, which sets the angular position of the wheel unit relative to the running gear frame or carriage body, for example in order to achieve optimal radial alignment of the wheel unit in relation to a track curve.

Further preferred variants provide for the control movements regulating the relative angle between outer wheel units of a vehicle comprising at least two wheel units in order to be able to achieve optimal alignment of the wheel units of the vehicle, for example in the track curve.

In principle, any input quantities which individually or in combination make it possible to draw conclusions about the current state, in particular about the current motion state of the vehicle and/or the wheel unit, may be used for control purposes. Preferably, control of the position of the wheel unit takes place depending on the radius of curvature and/or the travelling speed and/or unbalanced transverse acceleration and/or the coefficient of friction and/or the profile parameters between wheel and rail.

Further preferably, the following are used for the control method: the determined transverse travel of at least one wheel unit relative to the bogie frame or the carriage body, or the determined yaw angle of at least one wheel unit relative to the bogie frame or the carriage body. Likewise, additionally or as an alternative, the determined actuating distance or actuating angle of at least one actuating device, or the determined actuating forces of at least one actuating device may be used. Similarly, the determined travel speed, the determined speed or acceleration of the wheel unit in transverse direction or the determined yaw speed or yaw acceleration of the wheel unit may be used. Finally, in addition or as an alternative, the radius of curvature of the travel path may be used.

In principle, the actuating device may be designed as desired so as to achieve the respective control movements. Basically, it may be provided for the first and second control movements to be generated by a single actuating device. It must then only be ensured that the actuating device is designed so as to react sufficiently quickly to generate the second control movements in the second frequency range. It is of course also to be understood that different actuating devices may be provided for generating the first and the second control movements. Preferably, the actuating device is designed as an electrical, hydraulic or pneumatic actuating drive.

In principle, the number and arrangement of the actuating devices may be selected as desired. It is only necessary to ensure that the corresponding control movements can be generated reliably. In preferred variants of the device according to the invention, at least one actuating device is provided for each wheel of the wheel unit and, in addition or as an alternative, for each wheel bearing of the wheel unit, and, furthermore in addition or as an alternative, for each coupling of wheels of the wheel unit.

In principle, coupling between the actuating device and the wheel unit may be designed as desired. In advantageous variants of the device according to the invention, a gear arrangement may be provided between the actuating device and the wheel or wheel bearing of the wheel unit so as to simply generate the control movements or actuating forces of the desired extent by means of simple actuating devices.

The action, in particular the effective movement of the actuating device, may be matched to the required control movement. If, for example, a linear control movement is required or desired, then it is preferably provided for the actuating device to have a linear effective movement. However, if a rotary control movement is required or desired, it is preferably provided for the actuating device to have a rotary effective movement.

In principle, the arrangement of the actuating device can take place as desired depending on the desired coupling between the individual wheel units. For example, the actuating device can be arranged between the wheels of different sides of the vehicle, but it can also be arranged on one side of the vehicle, in particular between wheels on one side of the vehicle.

In order to ensure reliable operation even if individual actuating devices fail, preferred variants of the device according to the invention provide for the combination of several actuating devices for the purpose of creating redundancy, with those several actuating devices then advantageously serving to generate one and the same control movements and being able to individually generate said control movements even if the other control device or control devices have failed.

BRIEF DESCRIPTION OF THE DRAWINGS

Below, the invention is explained in more detail by way of example only with reference to the embodiments shown in the drawings. The following are shown diagrammatically (not to scale).

DESCRIPTION OF ILLUSTRATIVE EMBODIMENTS

Figure 1:
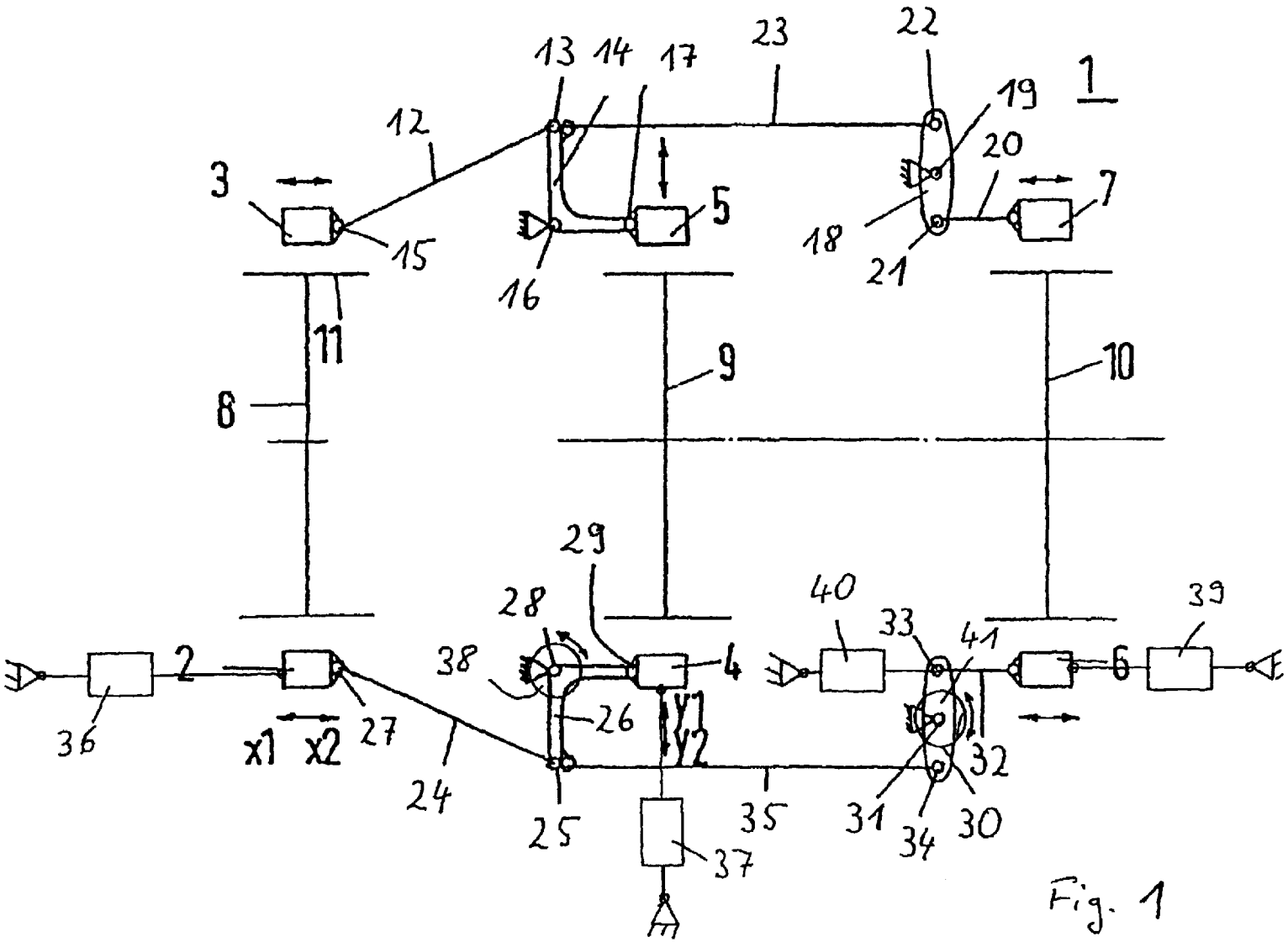
FIG. 1 a self-steering three-axle running gear or vehicle.

FIG. 1 shows a three-axle running gear 1 of a rail vehicle, e.g. a three-axle bogie or three coupled wheel units installed on the carriage body in the form of wheel sets or wheel pairs. Said running gear 1 comprises a bogie or carriage body frame (not shown in the FIG.) which comprises longitudinal and transverse beams. By way of spring elements (not shown) wheel bearing housings 2 to 7 of the three wheel units 8, 9, 10 are attached to the longitudinal beams, namely wheel bearing housings 2, 3 for the first wheel unit 8 (outer wheel unit), wheel bearing housings 4, 5 for the second wheel unit 9 (central wheel unit), and wheel bearing housings 6, 7 for the third wheel unit 10 (outer wheel unit). The wheel units 8, 9, 10 comprise wheels 11. The wheel units 8, 9, 10 may be driven by drive motors (not shown), for example axle suspension motors or motors mounted on the bogie frame.

The wheel bearing housings 2, 3, 6, 7 of the two outer wheel units 8, 10 are movable, inter alia, in the direction of travel or against the direction of travel of the rail vehicle, as indicated by directional arrows x1, x2. The wheel bearing housings 4, 5 of the central wheel unit 9 are movable, inter alia, perpendicular to the direction of travel of the rail vehicle, as indicated by directional arrows y1, y2.

In each instance the wheel bearing housings 2, 3, 4, 5, 6, 7 are only coupled on the same side of the running gear by way of steering-linkage rotary lever configurations.

An oblique steering linkage 12 is arranged between a joint 13 of an angular lever 14 and a joint 15 of the wheel bearing housing 3.

The angular lever 14 comprises a rotary axis 16 which is fixed to the frame, wherein said angular lever by way of joint 17 is connected via its second arm to the face of the wheel bearing 5 of the central wheel unit 9.

To the wheel bearing housing 7 a rotary lever 18 is associated comprising a central rotary axis 19 which is fixed to the frame, wherein the steering linkage 20 which leads to the wheel bearing housing 7 is connected to the first joint 21 of this rotary lever 18 and wherein the second joint 22 of this rotary lever 18 is connected to a steering linkage 23 whose other extremity leads to the already mentioned joint 13 of the angular lever 14.

In this embodiment the couplings of the wheel bearing housings 3, 5, 7 of one side of the running gear have been implemented so as to be symmetrical in relation to the longitudinal axis of the rail vehicle also on the wheel bearing housings 2, 4, 6 of the other side of the running gear.

An oblique steering linkage 24 is arranged between a joint 25 of an angular lever 26 and a joint 27 of the wheel bearing housing 2.

The angular lever 26 comprises a rotary axis 28 which is fixed to the frame and by way of joint 29 is connected via its second arm to the face of the wheel bearing 4 of the central wheel unit 9.

Associated to the wheel bearing housing 6 is a rotary lever 30 with a central rotary axis 31 which is fixed to the frame, wherein the steering beam 32 which leads to the wheel bearing housing 6 is coupled to the first joint 33 of this rotary lever 30, and wherein the second joint 34 of this rotary lever 30 is connected to a steering linkage 35 whose other extremity leads to the already mentioned joint 25 of the angular lever 26.

In order to generate the first and second control movements on the wheel units 8, 9 and 10, a number of actuating units in the form of simple actuating drives are provided whose arrangement and effect are described below.

Arranged on the wheel bearing housing 2 is a linear actuating drive 36 which acts in or against the direction of travel (x1, x2).

Arranged on the wheel bearing housing 4 is a linear actuating drive 37 which acts perpendicular to the direction of travel (y1, y2). As an alternative or in combination, a rotary-action actuating drive 38 is arranged in FIG. 1, with said rotary-action actuating drive 38 causing rotation about the rotary axis 28.

Arranged on the wheel bearing housing 6 is a linear actuating drive 39 which acts in or against the direction of travel (x1, x2). As an alternative or in combination, in FIG. 1 a linear-action actuating drive 40 which acts in or against the direction of travel (x1, x2) is arranged on the joint 33 of the rotary lever 30, as well as a rotary-action actuating drive 41. The actuating drive 41 causes rotation about the rotary axis 31.

The actuating drives 36 to 41 can be used individually or in combination, as desired. Combining several actuating drives 36 to 41 creates a redundancy so that, if one or several of the actuating drives 36 to 41 fails/fail, the others that have not failed will at least partially take over its or their function.

The method according to the invention comprises an integrated regulation which takes place in the interior of the running gear, i.e. without effective mechanical connection to the carriage body, simultaneously or integrated in at least two frequency ranges.

In a first frequency range, quasi-static setting of the wheel units 8, 9, 10 in track curves takes place by way of equalisation of the sums of the transverse forces which act upon the wheel units 8, 9, 10 of the running gear or vehicle. In other words, a transverse force resultant acts on each wheel unit, with said transverse force resultant essentially corresponding to the transverse force resultants on the other wheel units, at least as far as the amount is concerned.

In a second frequency range, control of the running stability takes place as has already been described above.

Thus, from measured momentary values of one or several state variables, which will be specified in more detail below, of the system, a representation of the current state of the mechanical system is determined. This takes place, for example, in the form of a corresponding stability matrix. This matrix is influenced by the non-changeable mechanical parameters of those elements of the system which cannot be actively controlled, such as for example springs etc. Likewise, the variable parameters of the actuating drives are also used in the determination of this matrix.

By means of suitable mathematical algorithms, this current stability matrix is checked for stability. If it is unstable, the actively influenceable variable parameters of the system description originating from the actuating drives are changed in a suitable manner such that, or until, a stable stability matrix results, i.e. a stable system results. The "stable" momentary values obtained in this way for the variable parameters originating from the actuating drives are then used for generating the control signals for the respective actuating drive. In this way, a stable system state can be brought about quickly, simply and effectively by way of the actuating drives. In contrast to known methods for stability control, this requires no acquisition of measured values over an extended period of time and no analysis of these measurement sequences (for example by means of Fourier transformation), which acquisition would only allow delayed reaction to the current motion state of the system.

Among other variables, the speed and the acceleration of the wheel unit in transverse direction, i.e. transverse to the longitudinal direction of the vehicle, as well as the speed and acceleration of the wheel unit about the vertical axis form part of the above-mentioned state variables. Depending on the control concept selected, at least one of these measured state variables or a combination of these measured state variables is used for stability control as described above.

The second frequency range comprises frequencies which are at least in part higher than frequencies from the first frequency range. This control controls fast-reacting actuating drives 36 to 41 which set the angular position of the wheel units 8 and 10 or the transverse displacement of the wheel unit 9 relative to the frame.

In this embodiment, the relative angle between the outer wheel units 8, 10 as well as the transverse displacement of the central wheel unit 9 are controlled.

As an alternative or in combination thereto, the absolute angle(s) of one or several and/or all wheel units 8, 9, 10 can be controlled in relation to a running gear frame or carriage body.

In this embodiment, regulation of the quasi-static setting of the respective wheel unit 8, 9, 10 takes place depending only on the radius of curvature of the track segment on which the rail vehicle currently travels. The radius of curvature is determined by means of measuring signals from corresponding sensors, for example transverse acceleration sensors and/or rotary acceleration sensors, rotary speed sensors and/or transverse speed sensors.

As an alternative to this, control of the position of the respective wheel unit 8, 9, 10 can take place depending on the radius of curvature, travelling speed, unbalanced transverse acceleration, coefficient of friction and/or profile parameters between the wheel 11 and the rail. Determination of these values is carried out with corresponding sensors as well.

The following may, for example, be used for the method: transverse travel of each wheel unit 8, 9, 10 relative to the frame; the yaw angle of each wheel unit 8, 9, 10 relative to the frame; the actuating distance or actuating angle of the actuating drives 36 to 41; the actuating forces or actuating moments of the actuating drives 36 to 41; the (absolute) travel speed; the (absolute) speed or (absolute) acceleration of the wheel unit in transverse direction; the (absolute) yaw speed or the (absolute) yaw acceleration of the wheel unit; and/or the radius of curvature; wherein the above having been obtained by means of corresponding sensors, for example transverse acceleration sensors and/or rotary acceleration sensors, rotary speed sensors and/or transverse speed sensors.

For this purpose there is no need for a frequency analysis of the movements of the wheel pairs or wheel sets; consequently, no frequency analysis takes place.

The device according to the invention comprises a control device (not shown in FIG. 1) wherein said control device is connected to the respective control input ports of the actuating drives 36 to 41. This is used both for quasi-static setting and for stability control of the wheel units 8, 9, 10 of the rail vehicle comprising at least two, in this embodiment three, wheel units 8, 9, 10 or of a bogie on a rail vehicle comprising at least two wheel units.

The actuating drives 36 to 41 generate first control movements in the form of quasi-static excursions and forces corresponding to the radius of curvature of a track segment to be travelled along, for example a track curve, and superimpose second control movements in the form of excursions and forces with higher frequency for stabilising the running characteristics of the vehicle, both, while the vehicle travels along a curve and while it travels along a straight section of track.

The actuating drives 36 to 41 generate excursions and forces corresponding to the specifications of the control device.

The actuating drives 36 to 41 cause rotation of the wheel units 8, 10 about the vertical axis and/or translatory movement of the wheel unit 9 in transverse direction.

Generation of force in the actuating drives 36 to 41 takes place electrically, hydraulically, pneumatically or by means of a combination of these methods.

As shown in this embodiment, on one side of the running gear, at least one actuating drive 36 to 41 is provided for each wheel 11 or wheel bearing of the wheel unit 8, 9, 10.

An actuating drive 36 to 41 acts upon at least two wheels which are coupled to each other. The coupling may be arranged between a wheel 11 and a further wheel 11 of the same wheel unit 8, 9, 10 as shown in this embodiment, or the coupling may be arranged on the wheel of another wheel unit on the same side of the vehicle or on the opposite side of the vehicle.

Transmission of the force or the moment of the actuating drives 36 to 41 is directly or by way of a gear unit arranged in between.

In this embodiment, the effective movement of the actuating drives 36, 37, 39, 40 is linear. The actuating drives 36, 37, 39, 40 can simultaneously carry out the function of a steering linkage. They act in addition to any passive coupling that may be incorporated, and are connected to such passive coupling by way of levers or steering gear.

As an alternative thereto, the actuating drive can have a rotary action as it is the case in the embodiment for the actuating drives 38, 41. In this case, it can at the same time carry out the function of a pivot bearing. It acts in addition to any passive coupling that may be incorporated, and is connected to such passive coupling by way of levers or steering gear or by way of a rotary coupling.

Figure 2:
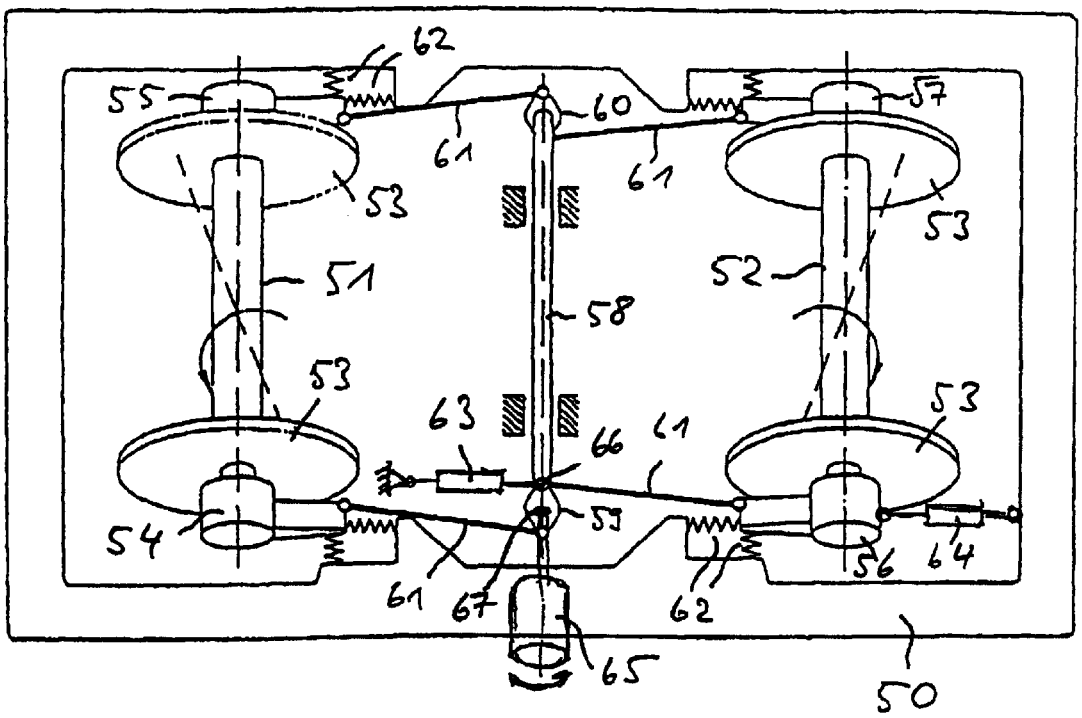
FIG. 2 a two-axle running gear or vehicle.

FIG. 2 shows the running gear of a rail motor vehicle. A bogie frame or carriage body frame 50, two wheel units 51, 52, with wheels 53 and wheel bearing housings 54 to 57 are shown. The wheel units 51, 52 are held in bearings so as to be radially controllable by means of a rotary shaft 58, rotary levers 59, 60 and steering linkages 61 and are connected to the frame 50 by means of primary spring elements 62.

Actuating drives 63 to 65 generate first control movements in the form of quasi-static excursions and forces corresponding to the radius of curvature of a track segment to be travelled along, for example a track curve, and superimpose second control movements in the form of excursions and forces of higher frequency for stabilising the running characteristics of the vehicle, both, while the vehicle travels along a curve and while it travels along a straight section of track.

The actuating drives 63 to 65 generate excursions and forces according to the specifications of a connected control device according to the invention (not shown in FIG. 2).

The actuating drives 63 to 65 cause rotation of the wheel units 51, 52 about the vertical axis.

Generation of force in the actuating drives 63 to 65 takes place electrically, hydraulically, pneumatically or by means of a combination of these methods.

In this embodiment, the actuating drives 63 to 65 for example act on both wheel units 51, 52, since said wheel units 51, 52 are coupled by way of the rotary shaft 58, the rotary levers 59, 60 and the steering linkages 61. The linear actuating drive 63 is arranged on a point of the joint 66 of the rotary lever 59. The linear actuating drive 64 is arranged on the wheel bearing housing 56 of the wheel unit 52. The rotary actuating drive 65 is arranged on the rotary lever 59 and causes rotation about a horizontally aligned rotary axis 67.

One, several or all of the actuating drives 63 to 65 may be provided. If several of the actuating drives 63 to 65 are used, it is imaginable that certain actuating drives are used for generating the first actuating movements, in other words the quasi-static setting of the wheel units according to the track curve (i.e. generally speaking in the lower frequency range) while others are used for generating the second control movements, in other words the stability control (i.e. generally speaking in the higher frequency range).

Combining several actuating drives 63 to 65 creates a redundancy so that, if one or several of the actuating drives 63 to 65 fails/fail, the others that have not failed will at least partially take over its or their function.

The rotary shaft 58 may be omitted; instead, in this case, at least one actuating drive of the type 63 to 65 is arranged on each side.

In a first frequency range, quasi-static setting of the wheel units 51, 52 in track curves takes place by way of equalisation of the sums of the transverse forces which act upon the wheel pairs or wheel sets 51, 52 of the running gear or vehicle. In other words, a transverse force resultant is achieved which acts on each wheel unit, with said transverse force resultant corresponding to the transverse force resultants on the other wheel units, at least as far as the amount is concerned.

In a second frequency range, control of the running stability as described above takes place. The second frequency range comprises frequencies which at least in part are higher than frequencies from the first frequency range. The control device with which this control system is implemented drives the fast-reacting actuating drives 63 to 65 which set the angular position of the wheel units 51, 52 relative to the frame.

In this embodiment, too, the relative angle between the wheel units 51, 52 is controlled. Control of the quasi-static setting of the respective wheel unit 51, 52 in this embodiment, too, takes place exclusively depending on the radius of curvature of the track segments on which the rail vehicle currently travels.

Figure 3:
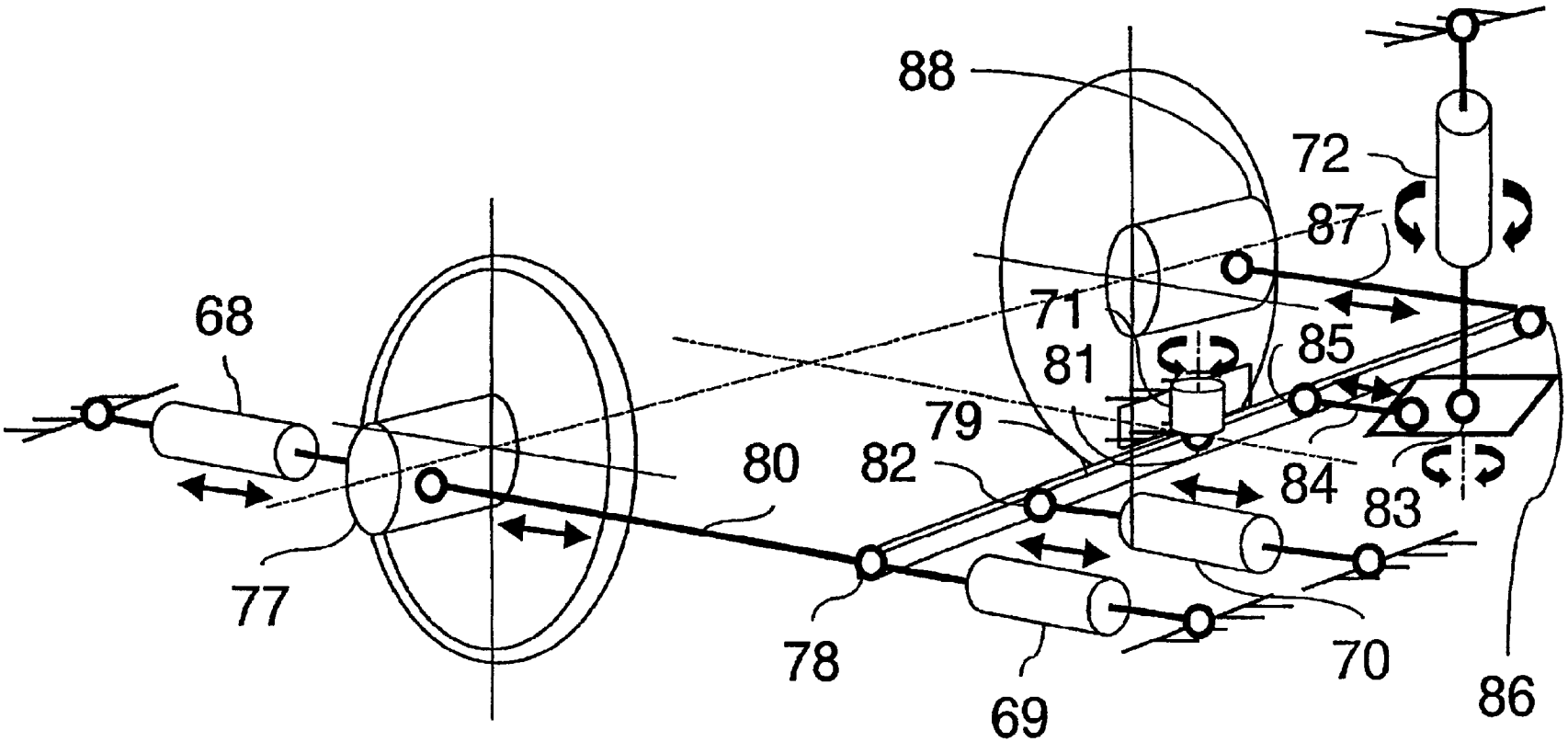
FIGS. 3 to 7 in each instance a wheel pair or a wheel set of a running gear or a vehicle with active radial control in various embodiments.
Figure 4:
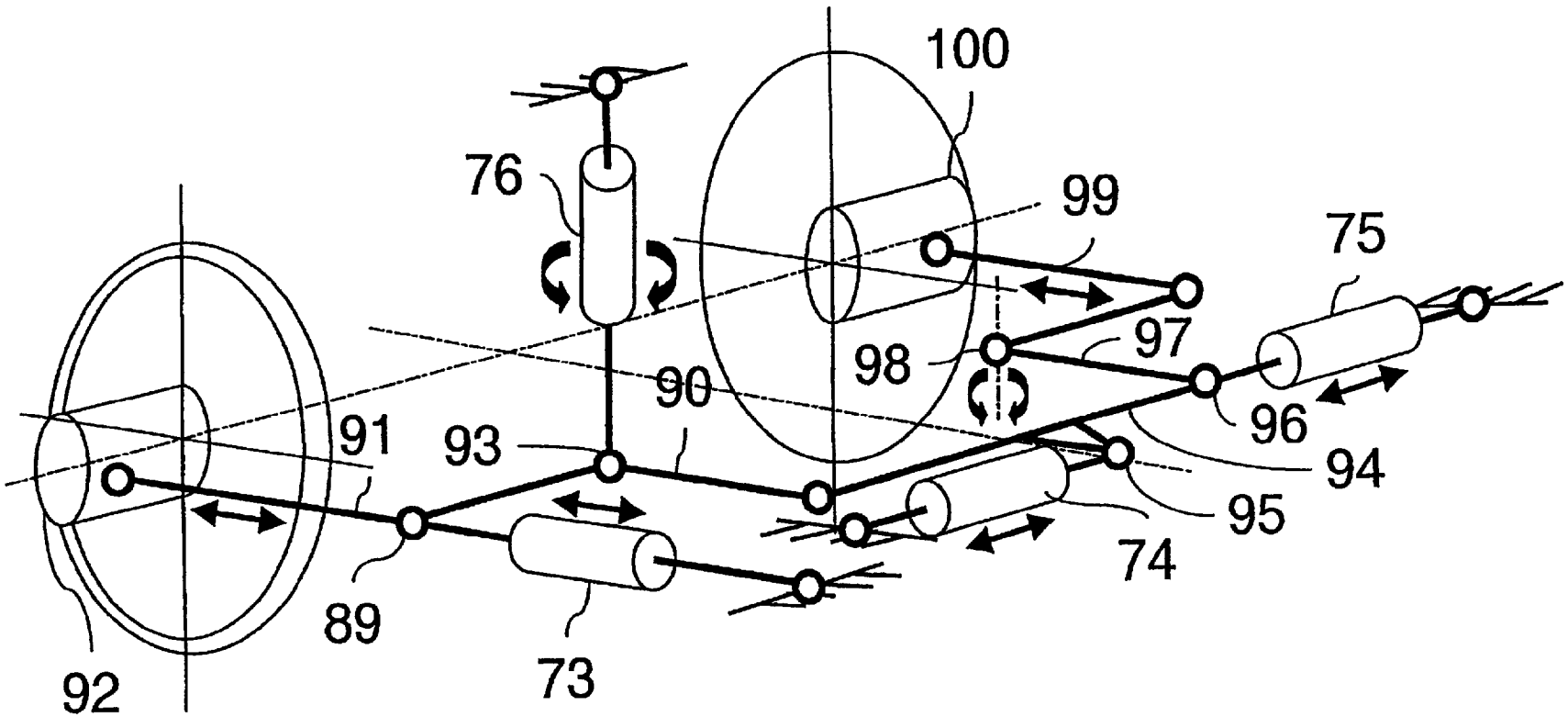

FIGS. 3 and 4 each show individual wheel units of running gears or vehicles with active radial controls and different arrangement options of one or several actuating drives 68 to 76.

In FIG. 3, the linear actuating drive 68 is arranged on a wheel bearing housing 77. The linear actuating drive 69 is arranged on a joint 78 at the end of a steering beam 79. The joint 78 is at the same time connected to the wheel bearing housing 77 by way of a steering linkage 80. The steering linkage 80 is rotatably held on a vertical rotary axis 81 which intersects the centre line of the vehicle. The linear actuating drive 70 is arranged on a joint 82 which is also arranged on the steering beam 79, outside the rotary axis 81. The rotary actuating drive 71 is arranged on the pivot point 81 of the steering beam 79. The rotary actuating drive 72 is connected to a joint 85 of the steering beam 79 outside the rotary axis 81 by way of a rotary lever 83 and a steering linkage 84. The steering beam 79 is connected to a wheel bearing housing 88 by way of a joint 86, arranged at the end of said steering beam 79, and by way of a steering linkage 87 attached to said joint 86.

By way of a joint 89 with a limb of an angular lever 90 and a steering linkage 91, the linear actuating drive 73 (FIG. 4), which acts in the direction of travel, acts on a wheel bearing housing 92. The angular lever 90 is held on a horizontal rotary axis 93 which is coupled to a rotary actuating drive 76. The linear actuating drives 74, 75 act in parallel on a steering beam 94. This takes place by way of a joint 95 on the steering beam 94 or by way of a joint 96 of a limb of an angular lever 97. The angular lever 97 is held on a vertical rotary axis 98 and at its other end is connected to a wheel bearing housing 100 by way of a joint and a steering linkage 99. These actuating drives 73 to 76, too, may be used individually or in combination for increased redundancy.

Figure 5:
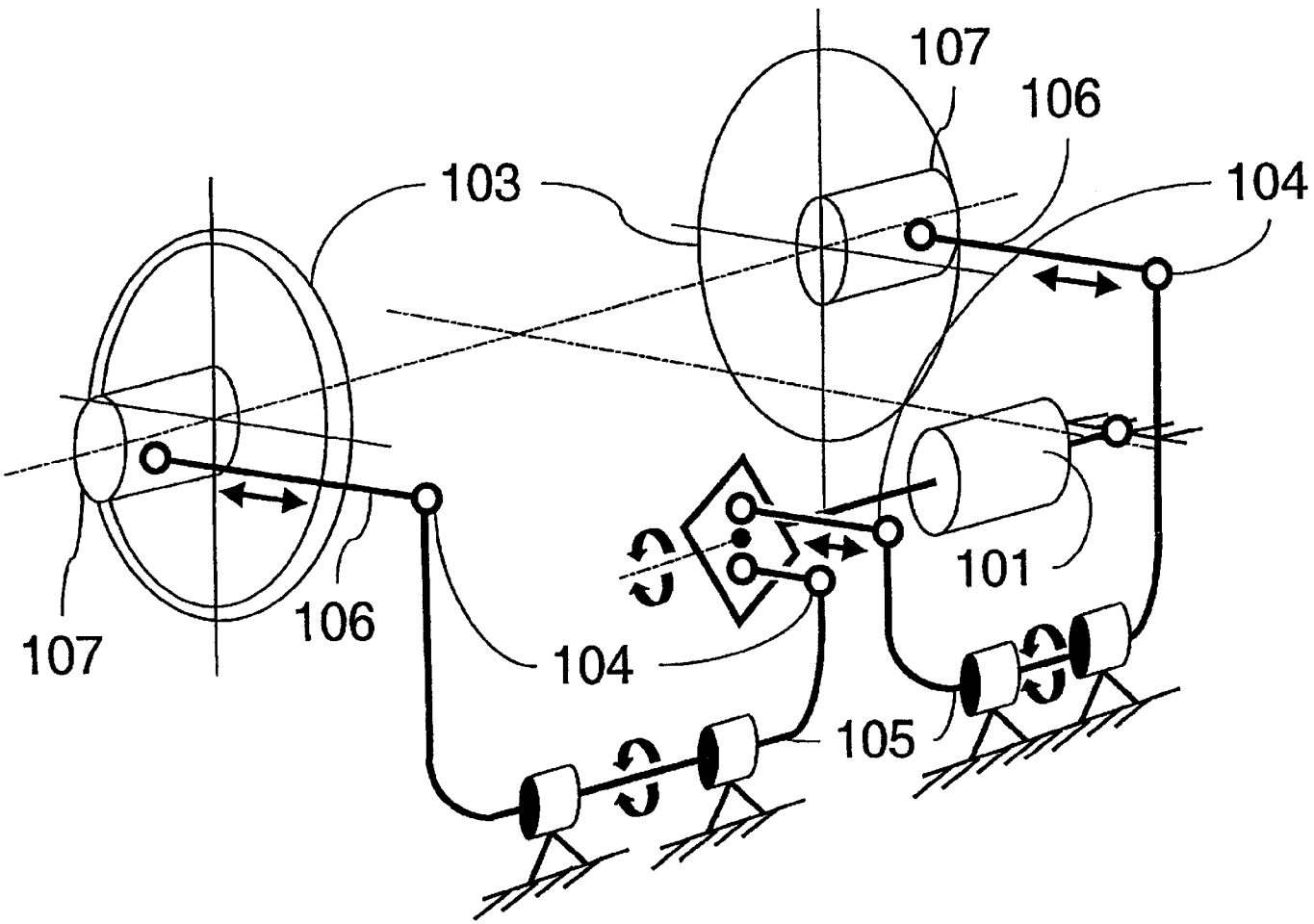
Figure 6:
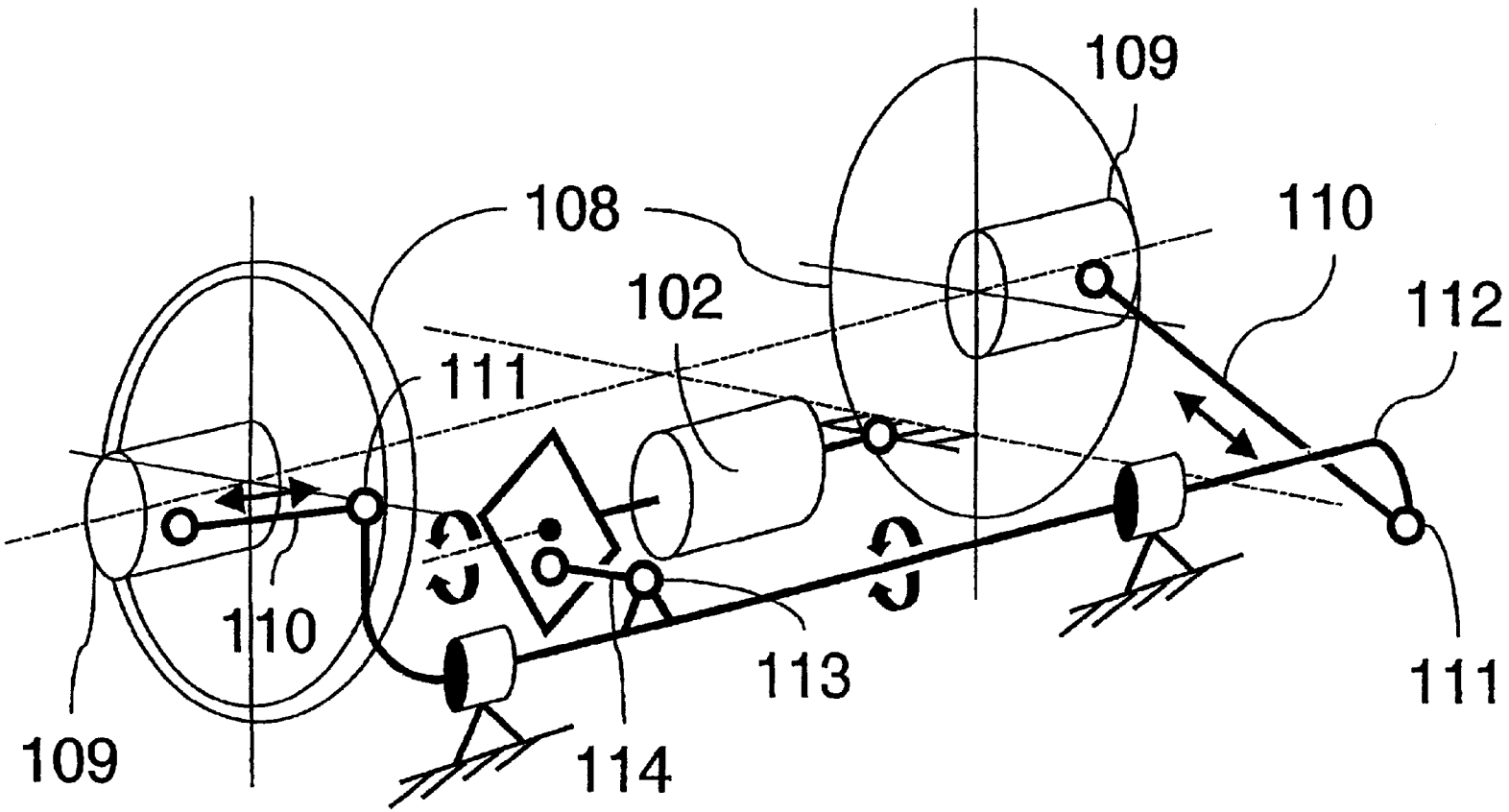
Figure 7:
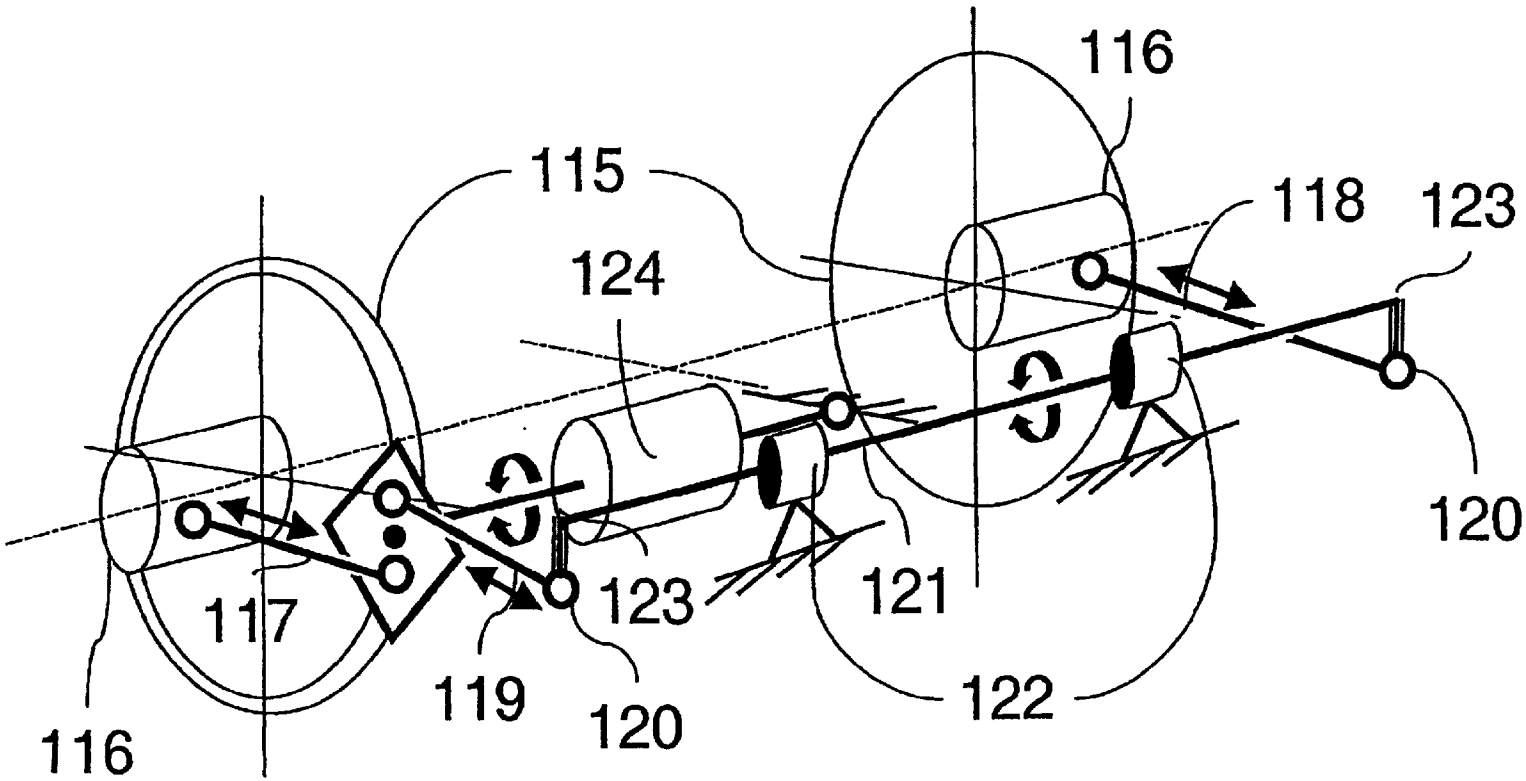

FIGS. 5 to 7 show individual wheel units of a running gear or a vehicle, in each case with an actuating drive 101, 102.

In FIG. 5, the rotary actuating drive 101 at the same time carries out the function of coupling the two wheels 103 by way of: corresponding joints 104; rotary shafts 105, which at both ends are angled by 90° and which are held so as to be rotatable about their longitudinal axis; steering linkages 106; and wheel bearing housings 107. Thus, the actuating drive 101, at the same time, sets both wheels 103 according to the stability control and causes rotation of the wheels 103 about the vertical axis. In other words, the actuating drive 101 simultaneously generates the first and the second control movements.

In FIG. 6, two wheels 108 with their associated wheel bearing housings 109 are coupled by way of: steering linkages 110, joints 111 and a rotary shaft 112, which at both ends is angled by 90° in opposite directions and which is held so as to be rotatable on its longitudinal axis. The rotary actuating device 102 which lets the rotary shaft 112 rotate about its longitudinal axis and thus lets the wheels 108 rotate about the vertical axis, is arranged between the angled ends of the rotary shaft 112, by way of a joint 113 and a steering linkage 114.

Both in the version according to FIG. 5 and in the version according to FIG. 6, the actuating drives 101, 102 may be arranged approximately in the middle between the wheels 103, 108. The optimal installation location depends on the space requirement and the weight distribution of the individual components.

FIG. 7 shows a further version of an individual wheel unit with coupled wheels 115. Coupling is provided by way of wheel bearing housings 116, steering linkages 117, 118, 119 arranged thereon, joints 120 and a rotary shaft 121. The rotary shaft 121 is held rotatably about its longitudinal axis by means of bearings 122 attached to the frame. At the ends of the rotary shaft 121, levers 123 are arranged for connection with the steering linkages 118, 119 by way of joints 120. The two steering linkages 117, 119 are connected to a rotary actuating drive 124 which causes rotation of the wheels 115 about the vertical axis. The rotary actuating drive 124 can thus be arranged on the side of the frame.

Many modifications in addition to those described above may be made to the structures and techniques described herein without departing from the spirit and scope of the invention. Accordingly, although specific embodiments have been described, these are examples only and are not limiting upon the scope of the invention.

What is claimed is:

1. A method for active radial control of wheels of at least one wheel unit of a running gear of a vehicle when traveling through a curve, the method comprising an integrated control with control movements in at least two non-identical frequency ranges;

wherein first control movements in a first frequency range are applied to achieve a quasi-static setting of said wheels and a predetermined distribution of the transverse forces acting on said wheels of said wheel units of said running gear; and second control movements in a second frequency range, different from said first frequency range, are superimposed on said first control movements and applied to said wheel unit.

2. The method according to claim 1, wherein the vehicle has a carriage body and said running gear comprises a bogie and wherein said integrated control is arranged to be effective within the running gear, without any mechanical effective connection to the carriage body.

3. The method according to claim 1, wherein said control movements in said first frequency range result in an equalisation of sums of the transverse forces acting on said wheels of said wheel units of the running gear takes place.

4. The method according to claim 1, wherein said control movements in said first frequency range result in a distribution of the sums of the transverse forces acting on said wheels of said wheel units of said running gear such that the running behaviour is matched to specifiable operating and maintenance conditions.

5. The method according to claim 1, wherein control of running stability of said vehicle takes place as a result of said control movements in said second frequency range.

6. The method according to claim 1, wherein said second frequency range comprises frequencies which are, at least in part, higher than frequencies from said first frequency range.

7. The method according to claim 1, wherein said second frequency range is arranged above said first frequency range.

8. The method according to claim 1, wherein said second frequency range continues from said first frequency range.

9. The method according to claim 1, wherein said first frequency range is arranged between 0 Hz and 3 Hz.

10. The method according to claim 1, wherein said second frequency range is arranged between 0 Hz and 10 Hz.

11. The method according to claim 1, wherein said control controls at least one fast-reacting actuating device which sets an angular position of said wheel unit relative to a frame of said running gear or a carriage body.

12. The method according to claim 1, wherein the vehicle comprises at least two wheel units and by means of said control movements, a relative angle between outer wheel units of said at least two wheel units is controlled.

13. The method according to claim 1, wherein by way of said control movements, an absolute angle of at least one wheel unit is controlled in relation to a frame of said running gear or a carriage body.

14. The method according to claim 1, wherein the vehicle is a rail vehicle traveling along rails and control of a position of said wheel unit takes place depending on a radius of rail curvature or a travelling speed or an unbalanced transverse acceleration or a coefficient of friction or profile parameters between said wheels and the rails.

15. The method according to claim 1, wherein at least the second control movements are determined on the basis of signals determined on the basis of one of the following: a determined transverse travel of at least one wheel unit relative to a bogie frame or a carriage body; a determined yaw angle of at least one wheel unit relative to a bogie frame or a carriage body; a determined actuating distance or actuating angle of at least one actuating device a determined actuating force[s] of at least one actuating device; a determined travelling speed; a determined speed or acceleration of said wheel unit in a transverse direction; a determined yaw speed or yaw acceleration of said wheel unit; a radius of curvature of a travel path without frequency analysis of said signal.

16. A device for active radial control of at least one wheel unit of a vehicle, comprising:

at least one actuating device connected to said wheel unit for applying control movements to said wheel unit and an integrated control device connected to said actuating device for controlling said actuating device, wherein said control device is arranged to control said actuating device to apply to said wheel unit—first control movements in a first frequency range for generating quasi-static excursions of said wheel unit corresponding to a radius of curvature of a track segment to be currently travelled along and a predetermined distribution of transverse forces acting on said wheels of said wheel units of said running gear; and in a second frequency range, which differs from said first frequency range, said control device applies to said wheel unit second control movements which are superimposed on said first control movements, said second control movements serving to generate excursions of said wheel unit for stabilising running characteristics of said vehicle.

17. The device according to claim 16, wherein said actuating device is an electric, hydraulic or pneumatic actuating drive.

18. The device according to claim 16, wherein the vehicle comprises a plurality of wheels or couplings of wheels and a plurality of wheel bearings and wherein at least one actuating device is provided per wheel of said wheel unit or per each wheel bearing of said wheel unit or per each coupling of wheels of said wheel unit.

19. The device according to claim 16, wherein the vehicle comprises a plurality of wheels and at least two wheels are coupled to each other.

20. The device according to claim 19, wherein at least two coupled wheels belong to a wheel unit or two coupled wheels belong to different wheel units, and wherein said coupled wheels are arranged on the same side of said vehicle or on opposite sides of said vehicle.

21. The device according to claim 18, wherein a gear arrangement is provided between said actuating device and said or said wheel bearing of said wheel unit.

22. The device according to claim 16, wherein said actuating device has a linear effective movement.

23. The device according to claim 16, wherein said actuating device has a rotary effective movement.

24. The device according to claim 18, wherein said actuating device is arranged between wheels on different sides of said vehicle.

25. The device according to claim 18, wherein one actuating device is arranged on one side of said vehicle.

26. The device according claim 16, wherein for the purpose of creating redundancy, several actuating devices are combined.

* * * * *